US005680946A

United States Patent [19]

Cochran

[11] Patent Number: 5,680,946

[45] Date of Patent: Oct. 28, 1997

[54] SEALABLE CONTAINER

[75] Inventor: Monroe A. Cochran, Ojai, Calif.

[73] Assignee: Spatz Laboratories, Oxnard, Calif.

[21] Appl. No.: 518,685

[22] Filed: Aug. 24, 1995

[51] Int. Cl.[6] ..... B65D 41/18

[52] U.S. Cl. ..... 215/317; 220/780; 220/796

[58] Field of Search ..... 215/316, 317, 215/320, 321, 324, 353, 43, 224; 220/306, 780, 796; 285/328, 423, 921

[56] References Cited

U.S. PATENT DOCUMENTS

| | | | |
|---|---|---|---|
| 1,134,427 | 4/1915 | Ullrich . | |
| 2,088,899 | 8/1937 | Chevreau . | |
| 2,215,161 | 9/1940 | Sapery . | |
| 2,309,000 | 1/1943 | Morrison . | |
| 2,482,368 | 9/1949 | Reichenbach . | |
| 2,710,614 | 6/1955 | Dulberg . | |
| 2,717,619 | 9/1955 | Whitman . | |
| 2,718,980 | 9/1955 | Strom . | |
| 2,753,991 | 7/1956 | Sherman . | |
| 2,840,229 | 6/1958 | Hopgood . | |
| 2,840,230 | 6/1958 | Lerner . | |
| 2,878,905 | 3/1959 | Langermeier . | |
| 2,998,893 | 9/1961 | Thomas . | |
| 3,122,256 | 2/1964 | Orr . | |
| 3,214,012 | 10/1965 | Mack . | |
| 3,375,047 | 3/1968 | Townsend . | |
| 3,416,868 | 12/1968 | Landen . | |
| 3,429,980 | 2/1969 | Guttmann . | |
| 3,470,930 | 10/1969 | Jurczenia . | |
| 3,508,678 | 4/1970 | Graham . | |
| 3,510,023 | 5/1970 | Ullman . | |
| 3,595,420 | 7/1971 | Miskin . | |
| 4,037,746 | 7/1977 | VerHage . | |
| 4,042,143 | 8/1977 | Biggins . | |
| 4,125,201 | 11/1978 | Birch . | |
| 4,230,230 | 10/1980 | Mumford . | |
| 4,383,620 | 5/1983 | Mumford . | |
| 4,422,559 | 12/1983 | Landis . | |
| 4,574,974 | 3/1986 | vonHoldt . | |
| 4,629,221 | 12/1986 | Lumsden et al. | 285/328 |
| 4,723,676 | 2/1988 | Kobayashi et al. | 215/317 X |
| 4,888,667 | 12/1989 | Hwang . | |
| 5,111,954 | 5/1992 | Gaudreault . | |
| 5,275,287 | 1/1994 | Thompson . | |
| 5,360,242 | 11/1994 | Argent | 285/921 X |

FOREIGN PATENT DOCUMENTS

| | | | |
|---|---|---|---|
| 1345466 | 10/1963 | France | 215/321 |
| 2056527 | 5/1971 | Germany | 215/321 |
| 6612459 | 11/1967 | Netherlands . | |
| 2039817 | 8/1980 | United Kingdom | 215/321 |

*Primary Examiner*—Allan N. Shoap
*Assistant Examiner*—Nathan Newhouse
*Attorney, Agent, or Firm*—Kenneth J. Hovet

[57] ABSTRACT

A dynamic joint connection is provided between the neck region of a base and the engagement end of a cap. The neck region comprises a reduced diameter end of the base which is offset from the base outer wall by a flat ledge. Located above the ledge a first axial distance, is a first convex rib. The interior surface of the cap engagement end is provided with a cap rib which is located a third axial distance above its abutment end. The third distance will locate the cap rib against the first rib on the down-sloping portion of its surface when the cap abutment end is in contact with the neck region ledge. The compressive force of the cap ring against the first rib will cause the abutment end to be biased downwardly against the ledge. This unstable condition creates a dynamic connection that maintains its integrity throughout rough handling, internal pressures and varying ambient conditions. The neck region can include a second rib. This rib will be in sealing contact with an inner cap wall when the cap rib and first rib are engaged. The spaced-apart sealing areas create a dead air chamber therebetween and provide an additional obstacle to the escape of volatile materials or dusts that may emanate from the materials stored within the base.

14 Claims, 1 Drawing Sheet

SEALABLE CONTAINER

BACKGROUND OF THE INVENTION

1. Field of the Invention

The present invention pertains to a base and cap which interfit to form an enclosed sealed container.

2. Description of Related Art

In the food, drug and cosmetic fields, there is a strong need for the development of containers that can sealingly enclose a sensitive product. Of particular interest are containers having closures that can be repeatedly opened and closed while retaining the ability to provide an air-tight seal. Attempts to achieve this objective may be characterized generally as involving the use of closure gaskets, threaded caps and snap-on lids. Representative patents describing the use of gaskets are U.S. Pat. Nos. 2,840,229 and 2,840,230. Both of these patents disclose a resilient sealing ring about the base of a cosmetic container which engages the inner surface of a closure cap. The resiliency of the gasket provides an airtight seal.

Typical threaded caps include internal flanges depending from the underside of the cap. As the cap is rotated onto the neck of the container, the flanges engage corresponding neck surfaces to form a variety of seals. The manner of engagement and the geometrical configuration of the inner flanges distinguish one design from another. Typical embodiments of this technology are shown in U.S. Pat. Nos. 4,383,620 and 5,275,287.

Lids that simply snap onto the container rim typically have indented peripheral skirt structures. As the lid is pressed down, the indentations engage corresponding recesses in the rim. In U.S. Pat. No. 2,718,980, a container rim is provided with a rounded peripheral recess which is engaged with a dissimilar rib to create at least two or more lines of sealing contact.

A somewhat similar arrangement is shown in U.S. Pat. No. 3,470,930. In this patent, the lid periphery is provided with an internal recess characterized by multiple flat surfaces. When the closure engages the container rim, the flat surfaces engage different annular portions of a rounded bead that extends about the rim circumference.

The opposite of the above is shown in U.S. Pat. No. 3,510,023. In this patent, spaced-apart outwardly extending ribs about the top of a container form a recess therebetween. A lid is provided having a complimentary bead that interfits within the recess between the ribs. The bead and recess have corresponding geometrical cross-sectional shapes to provide a tight uniform engagement on at least both sides of the respective parts.

It can be seen from the above descriptions that much of the prior art involve unusual geometrical shapes which are difficult and expensive to produce and require precise alignments and engagements to be effective. However, when the containers are constructed of plastic materials, this is a difficult objective to attain. Hot and cold ambient conditions, ozone degradation and multiple usages all function to cause warpage and a loss of elasticity over time. With the present invention, applicant capitalizes on the aforementioned disadvantages to effect a dynamic seal that is simpler, longer lasting and more effective than the prior art.

SUMMARY OF THE INVENTION

The present invention provides a sealable container comprising a base and cap that interfit at a joint region in a manner that utilizes dynamic forces to produce a highly effective and highly durable sealed joint. The joint is less complicated than the prior art and is therefore easier to construct and less costly. In particular, the joint region comprises an engagement area between the neck region of a container base and the engagement end of a closure cap. The neck region comprises a reduced diameter upper end portion of the base that extends from an annular ledge to a rim that defines the base top opening.

The cap engagement end extends upwardly a predetermined distance from an open end defined by an annular shaped abutment end. It overlies the aforementioned neck region and includes a cap rib which engages the annular down-sloping back contact portion of a first base rib to form a first sealing area. This down-slope engagement is unstable and results in an axial force pushing the abutment end of the cap strongly against the ledge of the base. This continuing bias greatly enhances the effectiveness and durability of the joint and effects a second sealing area. Because of the continuously acting compression and axial forces, both of the sealing areas are maintained tight through repeated use, elevated internal pressure, wide temperature variations and rough handling.

To further enhance the effectiveness of the overall joint, the base neck region may include a second rib and the cap may include a reduced diameter inner wall region. The location of each are longitudinally predetermined so that when the abutment end and ledge are against each other, the second rib will be in sealing contact with the cap inner wall. The above third sealing area also coacts with the first seal to produce an annular dead air space. Such space is especially effective in inhibiting the escape of vapors which may evolve from products being held inside the container.

DESCRIPTION OF THE PREFERRED EMBODIMENTS

Figure 1:
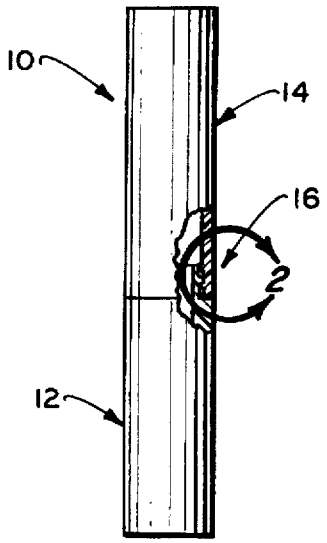
FIG. 1 is a side elevational view of the overall container of the invention showing a closure cap in sealing engagement with a base.

The innovations and advantages of the present invention are best illustrated by reference to a tubular shaped lipstick case. However, it will be apparent that the invention has application to all shapes and sizes of containers for retaining and dispensing a wide variety of food items, pharmaceutical items and cosmetic products.

The essence of the invention resides in the features of joint 16 formed between base 12 and cap 14. The joint encompasses the engagement structure between a reduced diameter base neck region 18 and a cap engagement end 20.

Figure 4:
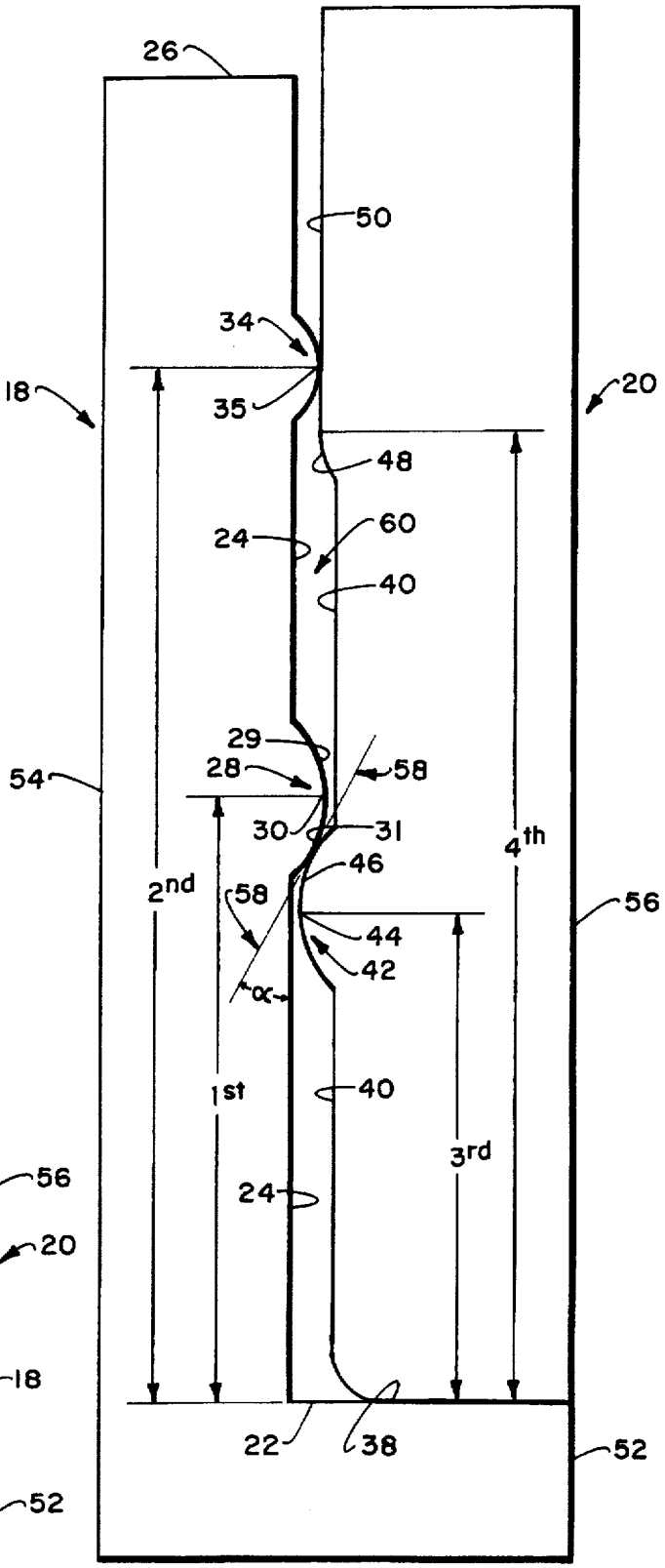
FIG. 4 is an enlarged schematic view of the joint region shown in FIG. 2.

As best shown in FIG. 4, the neck region 18 consists of a reduced diameter upper portion of base 12. It extends longitudinally from ledge 22 to rim 26. The rim defines the top opening of the base. For purposes of description, it may be assumed that the overall cross section of the container 10 is circular. However, oval or other rounded configurations are possible. If the container is not constructed of a plastic material which is inherently flexible, it is important that at least the engagement end 20 of the cap be resilient. This will be the source of the compressive forces utilized in the joint connection.

As shown, ledge 22 is above the base bottom at a location that is proximate the middle portion of the overall container. It extends horizontally inwardly from the circumference of outer base wall 52 to neck wall 24. Preferably, the ledge presents a radially flat annular area that is perpendicular to the longitudinal axis of the base.

The neck wall 24 extends coaxially from its junction with the ledge a predetermined distance that is coextensive with the longitudinal axis of the base. It terminates at rim 26 which has a top edge that extends inwardly to a juncture with inner base wall 54.

Inner wall 54 defines the interior chamber of the base which holds the material to be stored in the overall container. In the case of lipstick, it is expected that the chamber will include a lipstick housing and associated mechanical means for elevating and retracting the lipstick material in a manner known in the art.

Extending outwardly from neck wall 24 at a first axial distance from ledge 22 is first rib 28. The rib is convex in cross-sectional shape and presents a smooth exterior surface for a purpose to be hereinafter described. The surface includes a first crest portion 30 which is coextensive with said first axial distance. The surface area over the upper half side of the first crest portion is defined as front contact portion 29. The surface area on the lower half side is defined as back contact portion 31. The back contact portion is axially closer to ledge 22 than front contact portion 29. It slopes downwardly from the first crest portion to neck wall 24.

Located at a second axial distance from ledge 22 is second rib 34. Although not mandatory, it is preferred that this rib will extend from neck wall 24 a radial distance somewhat less than first rib 28. The second rib includes a second crest portion 35 which is located a distance coextensive with the aforementioned second axial distance.

Preferably, both the first rib and the second rib are provided with a uniform convex shape. They extend annularly about the neck wall in a plane that is perpendicular to the longitudinal axis of the container.

Cap 14 has a closed top end and a lower open end comprising cap engagement end 20. The engagement end is defined by outer cap wall 56 which terminates at abutment end 38. The abutment end comprises a flat annular surface that is perpendicular to the longitudinal axis of the container. It extends inwardly from outer wall 56 and merges into inner engagement wall 40. The inner engagement wall presents a cylindrical inner surface that is concentric with the neck wall 24. From end 38, it extends longitudinally a predetermined fourth axial distance to shoulder 48.

The shoulder inclines inwardly and merges with inner cap wall 50. The inner cap wall is concentric with neck wall 24. Its inner diameter is about equal to the diameter of second crest portion 35. In this way, when the cap and base are fully engaged, the second crest portion will have sufficient radial extent to be in sealing contact with the inner cap wall.

Located a third axial distance from the abutment end is cap rib 42. This rib extends inwardly from inner engagement wall 40 a predetermined distance and defines a convex shape having a smooth circumference. It includes a cap crest portion 44 that is coextensive with the aforesaid third axial distance.

The cap rib includes a rear contact portion 46 that is located an axial distance from said abutment end a distance greater than said cap crest portion. It is preferred that the distance the cap rib extends radially inward from engagement wall 40 be about equal to the distance first rib 28 extends outwardly from neck wall 24.

It will be appreciated that the third axial distance is less than the first axial distance by an amount that is between one-fourth and one-half the overall width of either of said first rib or the cap rib. In this way, when abutment end 38 is against ledge 22, rear contact portion 46 of the cap rib will be in engagement with back contact portion 31 of the first rib. In this position, neither first crest portion 30 nor cap crest portion 44 will be in contact with opposing wall surfaces because of the about equal radial extent of each rib. Therefore, the full force of compression will be directed to the line of contact between the cap rib and first rib. Part of this radially inward force, however, is diverted to an axial force because the line of contact is on the down-sloping back contact portion 31 of first ring 28. This will create a continuing tendency for the cap rib to slip down off the first rib back contact portion. Of course, this will not be possible because of its predetermined position above abutment end 38.

Thus, an unstable dynamic tension is created as a result of the aforementioned geometrical configurations. This dynamic tension produces an inherently tighter seal and the creation of not only an enhanced annular contact area about the ribs, but a stronger more durable engagement between the flat surfaces of the ledge and abutment end.

It will be appreciated that the ribs could have different shaped convex surfaces. However, to enhance the dynamic tension, it is preferred that the rib crests not touch opposing wall surfaces.

It can also be seen that a steeper down-slope will create a stronger axial force. Thus, the greater the angle $\alpha$ is between contact point tangent line 58 and the opposing neck and inner engagement walls, the more compression force will be diverted to the axial force.

An additional seal is obtained by the presence of second rib 34. This rib has a convex shape with a second crest portion 35. It extends outwardly from neck wall 24 a distance that may be equal to or slightly less than the radial extent of first rib 28. This will permit the formation of an annular seal between the second crest portion and inner cap wall 50 without affecting the dynamic seal between the cap rib and first base rib.

Providing an additional annular seal area above the first dynamic seal area creates a dead air chamber 60. This chamber is especially effective when the overall container encloses a volatile material. Not only will the seal at the second crest portion 35 make it difficult for volatiles to pass therethrough, the chamber air will trap and further inhibit the passage of any escaped vapors.

It will also be appreciated that the creation of internal pressure within the enclosed container will tend to deflect outwardly engagement end 20. This deflection will have no adverse impact even if inner cap wall 50 is dislodged from contact with second crest portion 35. This is because the dynamic seal between the back contact portion 31 and rear contact portion 46 will simply move along the curved surface of each respective rib. Therefore, the dynamic seal will remain intact and the overall sealing force will actually be increased as a result of the deflection causing a leveraged coaction between the respective flat abutment end 38 and ledge 22.

Figure 2:
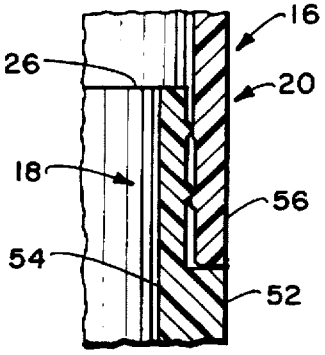
FIG. 2 is an enlarged fragmentary view taken along line 2 of FIG. 1.
Figure 3:
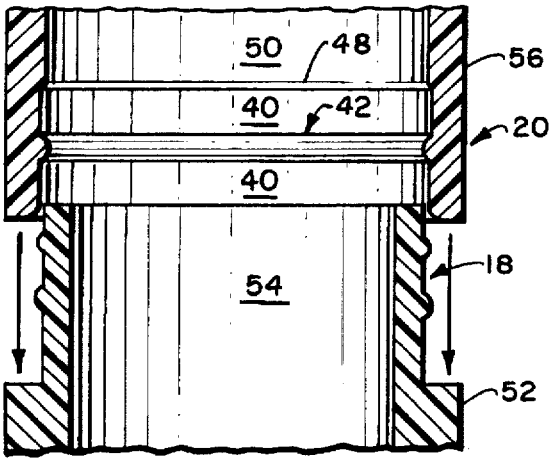
FIG. 3 is an enlarged fragmentary view similar to FIG. 2 with the cap in alignment above the base just prior to the sealing engagement step.

The method of forming the aforementioned hermetic seal at joint region 16 is best shown with reference to FIGS. 2 and 3. In FIG. 3, the cap is shown in position elevated above neck region 18 of base 12. Since the inner-diameter of cap rib 42 is less than first rib 28 and second rib 34, an axial force will be required to move the cap downwardly over neck region 18 and past the coacting ribs. During movement, the neck region will be compressed and the cap engagement end will incur a counteracting outward force.

As a result of the smooth surfaces of all the ribs, the cap rib will slide over the second rib 34, over the front contact portion 29 and past first crest portion 30. As the cap rib moves beyond the first crest portion, the second crest portion will slide past shoulder 48 and sealingly engage inner cap wall 50. At this position, the abutment end will come in contact with ledge 22 and downward axial movement of the cap will stop. This stoppage will result in the cap crest portion 44 being offset from the first crest portion 30.

Compressive forces will remain in the above first sealing area and the axial component of the compressive forces will function to enhance the second sealing area formed between the abutment end and the ledge. Because of the relatively wide flat area of each structure and the continuing axial force created by the unstable engagement of the cap rib and first rib, a durable joint connection is created which remains intact even during rough handling and sharp impacts.

The secondary seal between second rib 34 and inner cap wall 50 also enhances the effectiveness of the aforementioned seals by creating a chamber of dead air. This results in additional protection against the escape of volatile materials or vapors from materials contained in the container.

As can be seen from the foregoing descriptions, the present invention provides a dynamic joint between the engagement end of a cap and the neck region of a base. The use of threaded caps, elastic seals, deflectable skirts, fingers and flange mechanisms have all been avoided.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiments, but only by the scope of the appended claims.

I claim:

1. A joint between the engagement end of a cap and the neck region of a base wherein said engagement end has an inner engagement wall that merges into an inner cap wall and an abutment end and the neck region has a neck wall that extends from a ledge comprising:

a cap rib projecting inwardly from said inner engagement wall having a cap crest portion and a rear contact portion;

a first base rib projecting outwardly from said neck wall having a first crest portion and a back contact portion, said first base rib and cap rib being engaged with each other by offset sealing contact between said back contact portion and said rear contact portion when said abutment end is in contact with said ledge; and, a second base rib extending radially out from said neck wall a distance less than said first base rib but a distance sufficient to make sealing contact with said inner cap wall when said abutment end is in contact with said ledge.

2. The joint of claim 1 wherein said cap crest portion is out of contact with said neck wall and said first crest portion is out of contact with said inner engagement wall.

3. A method of forming dynamic seals in a joint region between a cap having a cap engagement end and inner engagement wall that terminates at an abutment end and a base having a base neck region with a neck wall extending from a ledge, said cap engagement end having an inner cap wall, comprising the steps of:

providing a first base rib extending outwardly from said neck wall at a longitudinal distance from said ledge, said first base rib having a first crest from which extends a down-slope surface;

providing a cap rib with a cap crest that extends inwardly from said inner engagement wall and is located a longitudinal distance away from said abutment end by an amount which is less than the longitudinal distance the first base rib is from said ledge;

providing a second base rib extending outwardly from said neck wall a radial distance less than said first base rib at a longitudinal distance from said ledge that is greater than the longitudinal distance between said first base rib and said ledge;

compressively stressing said neck region by moving said cap rib over said first base rib;

stopping movement of said cap rib by contacting said ledge with said abutment end when said cap rib engages said down-slope surface and said inner cap wall engages said second base rib.

4. The method of claim 3 wherein movement of said cap is stopped before said cap crest comes in contact with said neck wall.

5. The method of claim 3 wherein movement of said cap is stopped before said cap crest comes in contact with said neck wall and before said first crest comes in contact with said inner engagement wall.

6. A sealable container comprising:

a base with a top opening defined by a neck region having a neck wall offset inwardly from an outer base wall by a ledge, said neck region including a first rib extending outwardly from said neck wall at a first axial distance from said ledge, the outer surface of said first rib including a first crest portion and a back contact portion;

a cap sealingly enclosing said top opening having an engagement end terminating at an abutment end, said engagement end including an inner engagement wall that extends longitudinally a fourth axial distance and then merges into an inner cap wall;

a second rib extending radially outwardly from said neck wall a distance less than said first rib at a second axial distance from said ledge, said second rib including a second crest portion wherein said second axial distance is greater than said fourth axial distance whereby the second crest portion will be in contact with said inner cap wall when the abutment end of said cap is against the ledge of said base; and, a cap rib extending inwardly from said inner engagement wall at a third axial distance from said abutment end, the outer surface of said cap rib including a cap crest portion and a rear contact portion, said third axial distance being less than said first axial distance by an amount that is sufficient to locate said rear contact portion against said back contact portion when the abutment end of said cap is against the ledge of said base.

7. The container of claim 6 wherein said engagement end is biased toward said neck region.

8. The container of claim 7 wherein the engagement between said cap rib rear contact portion and said first rib back contact portion causes said bias to include an axial force that urges said abutment end toward said ledge.

9. In a method of forming a stressed joint between a cap and base wherein said base has a first rib with a down-slope surface and a second rib having a radial extent less than said first rib, said cap having an inner cap wall and a cap rib with a rear contact portion that is sealingly engagable with said down-slope surface, including the steps of:

1) forming a first sealing area by moving said cap over said base until said rear contact portion is in sealing engagement with said down-slope surface;

2) compressing said rear contact portion against said down-slope surface;

3) restraining said cap rib from sliding off said down-slope surface simultaneous with step 2); and 4) forming a second sealing area by sealingly engaging said second rib with said inner cap wall simultaneous with step 3).

10. The method of claim 9 wherein said base has an outer peripheral ledge and said cap has an open end that terminates at an abutment end that is sealingly engagable with said ledge, including the step of:

forming a third sealing area by abutting said abutment end against said ledge.

11. A dynamic joint between a cap having a closed end and an open end and a base having a closed bottom and a top opening comprising:

a flexible cap engagement end terminating at an abutment end that defines said cap open end, said engagement end having an inner engagement wall that merges into an inner cap wall;

a base neck region extending from a ledge extending about the periphery of said base above said bottom to a rim defining said top opening, said neck region having an outer neck wall;

a first rib extending outwardly from said neck wall at a first axial distance from said ledge, said rib having a down-sloping back contact portion;

a second rib extending radially out from said neck wall at a second axial distance from said ledge which is greater than said first axial distance, said second rib having a radial extent less than said first rib but sufficient to make sealing contact with said inner cap wall; and, a cap rib extending inwardly from said inner engagement wall at a third axial distance from said abutment end, said cap rib compressively engaging said down-sloping back contact portion and said second rib sealingly engaging said inner cap wall while said cap is being restrained from axial movement by the abutment of said abutment end against said ledge.

12. The joint of claim 11 wherein said first rib is out of contact with said inner engagement wall.

13. The joint of claim 12 wherein said cap rib is out of contact with said neck wall.

14. The joint of claim 11 wherein said ledge and said abutment end have mating surfaces that become sealed when engaged.

* * * * *